US011889958B2

(12) United States Patent
Moss et al.

(10) Patent No.: US 11,889,958 B2
(45) Date of Patent: Feb. 6, 2024

(54) ROTATING SHOWER ROD

(71) Applicant: House of Atlas, LLC, Evanston, IL (US)

(72) Inventors: Jason Moss, Libertyville, IL (US); Alan Arthur Ford, Sturgis, MI (US)

(73) Assignee: House of Atlas, LLC, Evanston, IL (US)

( * ) Notice: Subject to any disclaimer, the term of this patent is extended or adjusted under 35 U.S.C. 154(b) by 342 days.

(21) Appl. No.: 16/852,036

(22) Filed: Apr. 17, 2020

(65) Prior Publication Data

US 2020/0329919 A1 Oct. 22, 2020

Related U.S. Application Data

(60) Provisional application No. 62/835,205, filed on Apr. 17, 2019.

(51) Int. Cl.

| | |
|---|---|
| ***A47K 3/38*** | (2006.01) |
| ***A47H 1/122*** | (2006.01) |
| ***A47H 1/02*** | (2006.01) |

(52) U.S. Cl.

CPC ..... *A47K 3/38* (2013.01); *A47H 1/02* (2013.01); *A47H 1/122* (2013.01); *A47H 2001/0205* (2013.01)

(58) Field of Classification Search

CPC ..... A47K 3/38; A47H 1/0212; A47H 1/122; A47H 1/022; A47H 2001/0205; A47H 2001/0215

See application file for complete search history.

(56) References Cited

U.S. PATENT DOCUMENTS

| | | | | |
|---|---|---|---|---|
| 453,631 | A | 6/1891 | Farley | |
| 666,467 | A | 1/1901 | Clark | |
| 961,352 | A | 6/1910 | Walters | |
| 1,062,478 | A | 5/1913 | Kroder | |
| 1,374,026 | A | 4/1921 | Nelson | |
| 1,401,727 | A | 12/1921 | Pimlott | |
| 1,679,881 | A | 10/1925 | Simpson | |
| 1,756,716 | A | 4/1930 | Whitney | |
| 1,837,340 | A | 12/1931 | Schwartz | |
| 1,951,660 | A | 3/1934 | Klaudt | |
| 2,011,662 | A * | 8/1935 | Thompson | A47K 3/38 4/615 |

(Continued)

FOREIGN PATENT DOCUMENTS

WO WO-2012072988 A2 * 6/2012 ..... A47K 3/38

OTHER PUBLICATIONS

Rotator Rod "RotatorRod—What's in the Box 2015," Published May 7, 2015, <https://www.youtube.com/watch?v=7FBC1dN4Euw>. (Year: 2015).*

(Continued)

*Primary Examiner* — Abe Massad

(74) *Attorney, Agent, or Firm* — Fitch, Even, Tabin & Flannery LLP

(57) ABSTRACT

A rotating shower rod is provided to change the location of a curved shower rod between one position projecting outward from shower or bathtub enclosure to a second position projecting inward to the enclosure. Surface mounts provide two axes of rotation for the shower rod. The shower rod includes two tubes that telescopically extend and retract relative to one another.

18 Claims, 13 Drawing Sheets

(56) References Cited

U.S. PATENT DOCUMENTS 2,275,330 A 3/1942 Tveten
2,293,168 A 8/1942 Pirone
2,554,106 A * 5/1951 Heubeck ..... A47K 3/38 160/349.2
2,637,555 A 5/1953 Klaudt
2,661,850 A 12/1953 Fowler et al.
2,903,141 A 9/1959 Seewack
2,974,806 A 3/1961 Seewack
3,004,743 A 10/1961 Wenger
3,137,393 A * 6/1964 Marcus ..... A47H 1/022 211/105.1
3,560,032 A 2/1971 Cohen et al.
3,674,294 A 7/1972 Kirkham
4,134,703 A 1/1979 Hinners
4,405,111 A 9/1983 Lennon
4,419,026 A 12/1983 Leto
4,593,737 A * 6/1986 Clemente ..... E06B 9/327 160/84.06
4,653,714 A 3/1987 Andrasko, Jr.
4,700,918 A 10/1987 Andrasko, Jr.
4,754,504 A 7/1988 Cellini
4,895,471 A 1/1990 Geltz
5,022,104 A 6/1991 Miller
5,031,257 A * 7/1991 Jeffery ..... A47K 3/38 4/607
D324,328 S 3/1992 Pagan
D327,421 S 6/1992 Pagan
5,139,072 A * 8/1992 Marocco ..... E06B 9/307 160/176.1 R
5,156,281 A 10/1992 Schwartz
5,216,766 A * 6/1993 Lang ..... A47K 3/38 D6/578
5,259,520 A 11/1993 Roggio
5,303,832 A 4/1994 Tu
5,330,061 A 7/1994 Geltz
5,333,665 A 8/1994 Safar
5,345,624 A * 9/1994 Brown, III ..... A47K 3/38 81/3.43
5,433,551 A 7/1995 Gordon
5,549,407 A 8/1996 Levi
5,615,721 A 4/1997 Winter
5,628,356 A * 5/1997 Marocco ..... E06B 9/308 160/176.1 R
5,653,057 A 8/1997 Gary
5,678,703 A 10/1997 Sawyer
5,702,010 A 12/1997 Liang
D398,468 S 9/1998 Yemini
5,894,610 A 4/1999 Winter
5,996,674 A 12/1999 Gatewood
D421,692 S 3/2000 Wojtowicz
D429,934 S 8/2000 Hofman
6,216,287 B1 4/2001 Wise
D443,162 S 6/2001 Winter
D443,813 S 6/2001 Harwanko
6,250,839 B1 6/2001 Lenhart
D450,947 S 11/2001 Walker
D456,167 S 4/2002 Harwanko
6,443,207 B1 9/2002 Cheng
D466,798 S 12/2002 Rebman
D466,799 S 12/2002 Suero, Jr.
D470,332 S 2/2003 Clucas
6,520,351 B1 2/2003 Zadro
D472,453 S 4/2003 Rebman
6,543,629 B1 4/2003 Samelson
D475,551 S 6/2003 Kelso
D475,561 S 6/2003 Suero, Jr.
D475,562 S 6/2003 Suero, Jr.
6,581,790 B1 6/2003 Zadro
6,640,867 B1 11/2003 Pallotta
6,651,831 B2 11/2003 Samelson
D483,251 S 12/2003 Suero, Jr.
6,681,831 B1 1/2004 Cheng
6,694,543 B2 2/2004 Moore
D491,448 S 6/2004 Rebman
6,761,202 B1 7/2004 Cheng
D494,052 S 8/2004 Winter
D494,455 S 8/2004 Winter
D494,845 S 8/2004 Winter
6,823,925 B2 11/2004 Militello
6,824,000 B2 11/2004 Samelson
D499,329 S 12/2004 Suero, Jr.
D500,670 S 1/2005 Rebman
6,845,955 B1 1/2005 Hsu
D501,737 S 2/2005 Clucas
D501,738 S 2/2005 Clucas
6,865,817 B2 3/2005 Militello
D504,310 S 4/2005 Harwanko
D504,807 S 5/2005 Harwanko
D505,062 S 5/2005 Suero, Jr.
D505,317 S 5/2005 Harwanko
D507,129 S 7/2005 Harwanko
6,948,545 B1 9/2005 Cheng
6,959,752 B2 11/2005 Huang
6,962,186 B2 11/2005 Hsu
6,966,353 B2 11/2005 Hsu
D513,142 S 12/2005 Suero, Jr.
D513,373 S 1/2006 Harwanko
6,994,143 B2 2/2006 McCarty
7,000,521 B1 2/2006 Cheng
7,000,787 B2 2/2006 Felsenthal
D516,902 S 3/2006 Harwanko
D522,844 S 6/2006 Harwanko
D522,845 S 6/2006 Suero, Jr.
D522,846 S 6/2006 Suero, Jr.
D522,847 S 6/2006 Suero, Jr.
D525,115 S 7/2006 Harwanko
D525,813 S 8/2006 Beasley
D526,520 S 8/2006 Clucas
D527,246 S 8/2006 Clucas
D534,793 S 1/2007 Suero, Jr.
D538,571 S 3/2007 Militello
D539,064 S 3/2007 Militello
7,194,811 B2 3/2007 Militello
7,195,051 B2 3/2007 Nien
D542,392 S 5/2007 Hanley
D542,897 S 5/2007 Harwanko
D543,747 S 6/2007 Harwanko
D543,748 S 6/2007 Harwanko
D544,786 S 6/2007 Barrese
D545,180 S 6/2007 Harwanko
7,225,850 B2 6/2007 McCarty
D547,165 S 7/2007 Barrese
D547,166 S 7/2007 Barrese
D547,167 S 7/2007 Barrese
D548,574 S 8/2007 Harwanko
7,255,149 B2 8/2007 Rossato
D551,010 S 9/2007 Woodhouse
7,264,035 B2 9/2007 Rossato
D562,608 S 2/2008 Kramer
D562,609 S 2/2008 Kramer
7,331,370 B1 2/2008 Militello
D563,136 S 3/2008 Kramer
D563,138 S 3/2008 Kramer
7,346,940 B1 3/2008 Liao
D566,991 S 4/2008 Harwanko
D568,656 S 5/2008 Kramer
D569,149 S 5/2008 Walker
D569,668 S 5/2008 Kramer
D571,136 S 6/2008 Kramer
D573,386 S 7/2008 Clucas
D573,387 S 7/2008 Walker
D576,475 S 9/2008 Didehvar
D576,476 S 9/2008 Didehvar
D586,647 S 2/2009 Didehvar
D591,142 S 4/2009 Cittadino
7,549,615 B2 6/2009 Shevick
7,562,689 B1 7/2009 Militello
7,600,549 B2 10/2009 Cheng
7,641,161 B2 1/2010 Bauer
7,665,500 B2 2/2010 Rossato
D611,328 S 3/2010 Hanley
7,819,166 B2 10/2010 Militello
D628,000 S 11/2010 Lindo

(56) References Cited

U.S. PATENT DOCUMENTS 7,857,151 B2 12/2010 Barrese
D632,513 S 2/2011 Cittadino
D632,514 S 2/2011 Didehvar
D632,515 S 2/2011 Cittadino
7,877,824 B2 2/2011 Grant
D633,780 S 3/2011 Barrese
D635,807 S 4/2011 Lindo
D636,660 S 4/2011 O'Connell
7,926,127 B2 4/2011 Barrese
7,931,160 B2 4/2011 Newbouild
D640,488 S 6/2011 Didehvar
7,958,577 B2 6/2011 Chang
D641,190 S 7/2011 Cittadino
D641,191 S 7/2011 Walker
D641,193 S 7/2011 Vaccaro
D641,194 S 7/2011 Vaccaro
7,984,814 B2 * 7/2011 Didehvar ..... A47F 7/0028 211/13.1
D643,236 S 8/2011 Kyle
D643,657 S 8/2011 Cittadino
D644,050 S 8/2011 Cittadino
7,987,534 B2 8/2011 Lin
D647,391 S 10/2011 Barrese
D648,619 S * 11/2011 Lowe ..... A47H 1/022 D8/376
D648,969 S 11/2011 Cittadino
D649,352 S 11/2011 Cittadino
8,056,873 B1 11/2011 Hanely
D650,263 S 12/2011 Barrese
8,069,507 B2 12/2011 Didehvar
8,069,508 B2 * 12/2011 O'Connell ..... A47K 3/38 248/265
8,069,999 B2 12/2011 Kaveh
D652,236 S 1/2012 Walker
D652,237 S 1/2012 Cittadino
D653,067 S 1/2012 Cittadino
8,113,361 B2 2/2012 Winter
8,146,182 B2 4/2012 Bauer
8,157,111 B2 4/2012 Didehvar
D660,064 S 5/2012 Webb
D660,065 S 5/2012 Webb
D660,066 S 5/2012 Webb
8,166,583 B1 5/2012 Liang
8,185,981 B2 5/2012 Didehvar
D661,529 S 6/2012 Cittadino
D661,927 S 6/2012 Cittadino
8,205,760 B2 6/2012 Chang
D664,423 S 7/2012 Cittadino
D664,424 S 7/2012 Cittadino
8,214,938 B2 7/2012 Hanley
8,215,501 B2 7/2012 Trettin
8,225,946 B2 7/2012 Yang
D666,012 S 8/2012 Walker
D667,246 S 9/2012 Cittadino
D667,295 S 9/2012 Harwanko
D670,521 S 11/2012 Cittadino
D670,522 S 11/2012 Cittadino
D670,944 S 11/2012 Cittadino
D671,347 S 11/2012 Cittadino
D671,348 S 11/2012 Cittadino
D671,395 S 11/2012 Harwanko
D672,178 S 12/2012 Walker
D672,990 S 12/2012 Lindo
D672,991 S 12/2012 Cittadino
8,341,775 B2 1/2013 Didehvar
8,347,936 B2 1/2013 Martin
8,348,072 B2 1/2013 Whitehall
D680,421 S 4/2013 Martin
8,408,405 B2 4/2013 Yang
D681,422 S 5/2013 Lindo
D681,423 S 5/2013 Walker
D684,037 S 6/2013 Harwanko
8,479,932 B2 7/2013 Carney
8,505,129 B2 8/2013 Parker
8,522,373 B2 9/2013 Bauer
8,528,753 B2 9/2013 Woolley, II
D691,029 S 10/2013 Didehvar
D691,030 S 10/2013 Lindo
D691,031 S 10/2013 Harwanko
8,561,667 B1 10/2013 Hanley
D693,209 S 11/2013 Walker
8,573,416 B2 11/2013 Didehvar
8,578,995 B2 11/2013 Nelson
D696,573 S 12/2013 Didehvar
D702,112 S 4/2014 Cittadino
8,739,324 B2 6/2014 Napier
8,763,821 B2 7/2014 Yang
8,763,822 B2 7/2014 Didehvar
8,800,072 B2 8/2014 Chang
8,806,670 B2 8/2014 O'Connell
8,814,114 B2 8/2014 Baines
8,827,587 B2 9/2014 Didehvar
8,839,980 B2 9/2014 Baines
D714,571 S 10/2014 Walker
8,851,305 B2 10/2014 Didehvar
8,851,435 B1 10/2014 Bastien
8,869,999 B2 10/2014 Lindo
8,875,770 B1 11/2014 Martin
8,960,456 B2 2/2015 Didehvar
8,978,228 B2 3/2015 Didehvar
8,991,625 B2 * 3/2015 Bucklew ..... A47H 1/022 211/105.3
9,009,878 B2 4/2015 Baines
D729,618 S 5/2015 Bastien
D730,162 S 5/2015 Bastien
9,021,627 B2 5/2015 Parker
9,033,163 B2 5/2015 Hsu
9,066,637 B2 6/2015 Zeng
9,107,495 B2 8/2015 Lindo
9,107,496 B2 8/2015 Lindo
9,107,529 B2 8/2015 Didehvar
9,107,544 B2 8/2015 Cittadino
9,131,795 B2 9/2015 Didehvar
9,161,664 B2 10/2015 Zeng
9,204,764 B1 12/2015 Hanley
D746,667 S 1/2016 Vaccaro
9,271,592 B2 3/2016 Didehvar
9,339,151 B2 5/2016 Yang
9,357,860 B1 6/2016 Klowan
9,388,837 B1 7/2016 Hanley
9,474,421 B2 10/2016 Baines
9,554,674 B2 * 1/2017 Forrest ..... A47K 3/38
9,578,995 B2 2/2017 Hanley
9,693,660 B1 7/2017 Stelmarski
9,770,138 B2 9/2017 Engell
9,808,125 B2 11/2017 Jepson
D811,205 S 2/2018 Hanley
9,883,742 B2 2/2018 Yang
D813,021 S 3/2018 Hanley
D813,022 S 3/2018 Hanley
9,943,192 B2 4/2018 Yang
9,999,322 B2 6/2018 Hain
10,034,587 B1 7/2018 Elliot
10,051,985 B2 8/2018 Jones
10,064,523 B2 9/2018 Engell
10,070,748 B2 9/2018 Hanley
10,092,126 B2 10/2018 Baines
10,098,508 B1 10/2018 Switzer
D834,925 S 12/2018 Hanley
D834,926 S 12/2018 Hanley
D834,927 S 12/2018 Hanley
D847,613 S 5/2019 Hanley
10,278,529 B2 5/2019 Baines
D856,785 S 8/2019 Hanley
D858,259 S 9/2019 Hanley
D858,260 S 9/2019 Hanley
D859,963 S 9/2019 Hanley
10,463,199 B2 11/2019 Coratolo
10,485,383 B2 11/2019 Worden, IV
10,595,683 B1 3/2020 Stelmarski
10,758,091 B2 9/2020 Engell
2003/0209509 A1 11/2003 Felsenthal
2004/0182806 A1 9/2004 Figueroa
2005/0263655 A1 12/2005 Bauer

(56) References Cited

U.S. PATENT DOCUMENTS

| | | | | |
|---|---|---|---|---|
| 2005/0268394 | A1 | 12/2005 | Monk | |
| 2006/0070177 | A1 | 4/2006 | Bathurst | |
| 2006/0156465 | A1 | 7/2006 | Lavi | |
| 2006/0204322 | A1 | 9/2006 | Roiser | |
| 2006/0218717 | A1* | 10/2006 | van den Bosch | A47K 3/38 4/558 |
| 2007/0006377 | A1* | 1/2007 | Moore | A47K 3/38 4/558 |
| 2007/0006378 | A1* | 1/2007 | Moore | A47K 3/38 4/558 |
| 2007/0169260 | A1* | 7/2007 | Huang | A47K 3/38 4/558 |
| 2007/0170134 | A1 | 7/2007 | Bishop | |
| 2007/0174956 | A1 | 8/2007 | Heaslip | |
| 2008/0022451 | A1* | 1/2008 | Urlich | A47K 3/38 4/610 |
| 2008/0028513 | A1* | 2/2008 | Didehvar | A47K 3/38 248/265 |
| 2008/0115265 | A1 | 5/2008 | Heaslip | |
| 2008/0163418 | A1 | 7/2008 | Barrese | |
| 2009/0083905 | A1* | 4/2009 | O'Connell | A47K 3/38 4/608 |
| 2009/0223642 | A1 | 9/2009 | Militello | |
| 2009/0223917 | A1 | 9/2009 | Grant | |
| 2010/0206492 | A1 | 8/2010 | Shevick | |
| 2010/0316438 | A1 | 12/2010 | Sohn | |
| 2011/0198045 | A1* | 8/2011 | Wieland | A47K 3/38 160/368.1 |
| 2011/0284484 | A1 | 11/2011 | Lin | |
| 2012/0005823 | A1 | 1/2012 | Baines | |
| 2012/0017366 | A1 | 1/2012 | Barrese | |
| 2012/0036628 | A1 | 2/2012 | O'Connell | |
| 2012/0152872 | A1 | 6/2012 | Didehvar | |
| 2012/0152873 | A1 | 6/2012 | Didehvar | |
| 2012/0152874 | A1 | 6/2012 | Didehvar | |
| 2012/0217215 | A1 | 8/2012 | Emery | |
| 2012/0241399 | A1 | 9/2012 | Trettin | |
| 2012/0284914 | A1 | 11/2012 | Bauer | |
| 2013/0045041 | A1 | 2/2013 | Sohn | |
| 2013/0112639 | A1 | 5/2013 | Baines | |
| 2013/0334156 | A1 | 12/2013 | Baines | |
| 2013/0341474 | A1 | 12/2013 | Baines | |
| 2014/0124598 | A1 | 5/2014 | Vaccaro | |
| 2014/0131298 | A1* | 5/2014 | Didehvar | A47H 1/022 211/105.2 |
| 2014/0166603 | A1 | 6/2014 | Baines | |
| 2014/0224754 | A1 | 8/2014 | Baines | |
| 2014/0263123 | A1 | 9/2014 | Ford | |
| 2014/0317840 | A1 | 10/2014 | O'Connell | |
| 2014/0360959 | A1 | 12/2014 | Didehvar | |
| 2014/0360960 | A1 | 12/2014 | Didehvar | |
| 2015/0265086 | A1 | 9/2015 | Hanley | |
| 2015/0297038 | A1 | 10/2015 | Vaccaro | |
| 2016/0113447 | A1 | 4/2016 | Walker | |
| 2016/0374518 | A1 | 12/2016 | Baines | |
| 2017/0360261 | A1 | 12/2017 | Coratolo | |
| 2018/0008101 | A1 | 1/2018 | Engell | |
| 2018/0064279 | A1 | 3/2018 | Hanley | |
| 2018/0098656 | A1 | 4/2018 | Baines | |
| 2018/0296018 | A1 | 10/2018 | Baines | |
| 2018/0306219 | A1 | 10/2018 | Hanley | |
| 2019/0099034 | A1 | 4/2019 | Hanley | |
| 2019/0282017 | A1 | 9/2019 | Hanley | |
| 2021/0378433 | A1* | 12/2021 | Berman | A47H 1/022 |
| 2022/0110490 | A1* | 4/2022 | Chen | A47K 3/38 |

OTHER PUBLICATIONS

Rotator Rod "Rotator Rod—Installing the Curved Shower Rod for Small Bathrooms," Published Feb. 27, 2019, <https://www.youtube.com/watch?v=y1EB_9IEXW8>. (Year: 2019).*

Rotator Rod "Troubleshooting Your Curved Shower Rod—Rotator Rod," Published Feb. 5, 2015, <https://www.youtube.com/watch?v=4s93TRnONP4>. (Year: 2015).*

Curved Shower Rod—Amazon, <https://www.amazon.com/Rotating-Curved-Shower-Rod-Bathrooms/dp/B07GQ4TKFP/ref=sr_1_3_sspa?dchild=1&keywords=SHOWER+ROD+CURVED+FLIP&qid=1610556970&sr=8-3-spons&psc=1&smid=AQCFIMOGZOT1J&spLa=ZW5jcnlwdGVkUXVhbGImaWVyPUEyUzQwNkJNWUIYMU5EJmVuY3J5cHRIZElkPUEwMzAyNzM0N0VBMIRHMjVETDNZJmVuY3J5cHRIZEFkSWQ9QTA1MDU2NzYyVDgwUTZCV0tRRUtQJndpZGdldE5hbWU9c3BfYXRmJmFjdGlvbj1jbGlja1JIZGlyZWN0JmRvTm90TG9nQ2xpY2s9dHJ1ZQ ==>, publicly available before Jul. 30, 2019, 2 pages.

* cited by examiner

ROTATING SHOWER ROD

CROSS-REFERENCE TO RELATED APPLICATION

This application claims the benefit of U.S. Provisional Application No. 62/835,205, filed Apr. 17, 2019, which is hereby incorporated by reference in its entirety.

FIELD

The subject matter of this application relates to shower rods and, more particularly, to rotating curved shower rods.

BACKGROUND

Shower rod are used to suspend shower curtains for shower and/or bathtub enclosures. Shower rods that curve outward from the enclosures have been used to increase the space in the enclosure. These curved shower rods have been designed to rotate from their outward curved configuration for using the enclosure to a second position curving into the enclosure to increase the usable size of the bathroom when not using the enclosure. There is a need for an improved rotating curved shower rod assembly.

DETAILED DESCRIPTION

Figure 1:
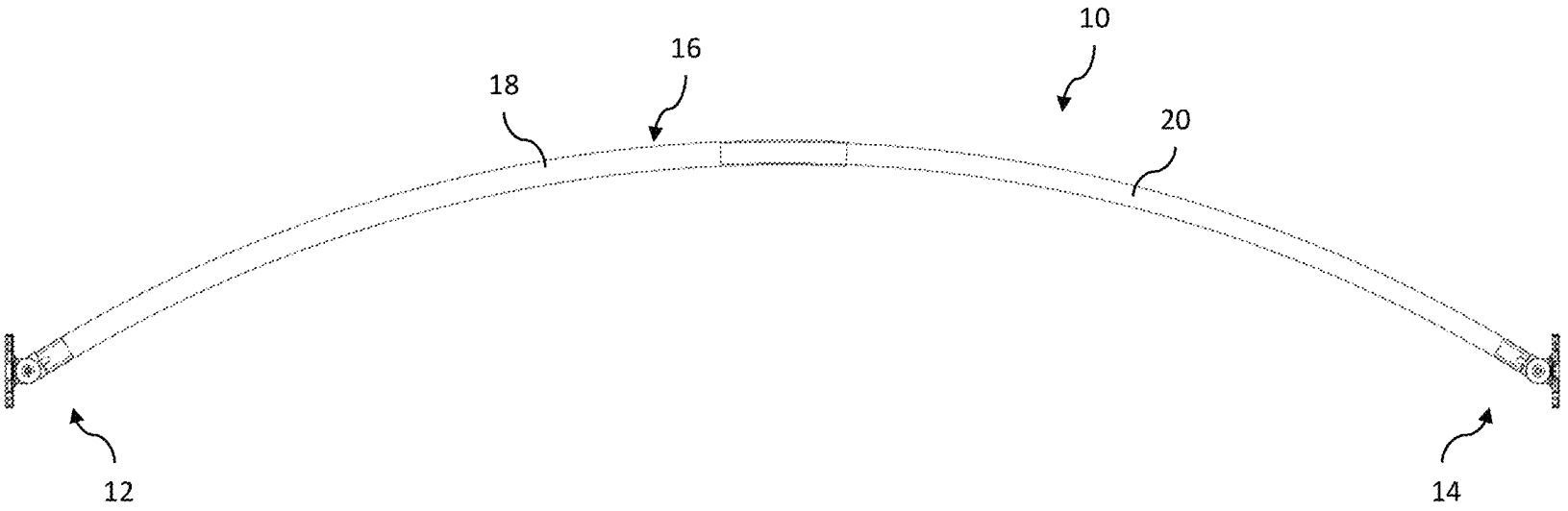
FIG. 1 is a top plan view of a shower rod assembly embodying features of the present invention.

FIG. 1 illustrates a curved rotating shower rod assembly 10. The shower rod assembly 10 supports a shower curtain.

The shower rod assembly 10 includes left and right surface mounts 12, 14. The surface mounts 12, 14 enable the shower rod assembly 10 to pivot from curving outward of a bathtub into the surrounding room to curving inward into the bathtub area. This provides the flexibility to enlarge the area in the bathtub when in use and to increase the area of the bathroom when the bathtub is not in use.

Figure 2:
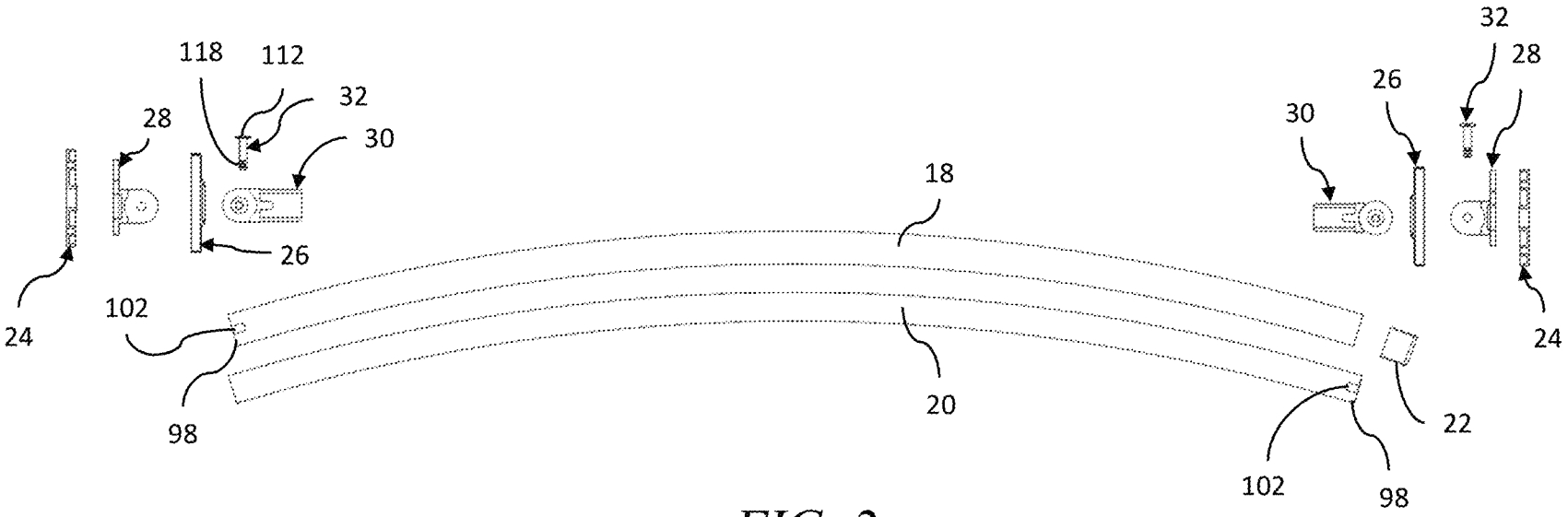
FIG. 2 is a top plan, exploded view of the shower rod assembly of FIG. 1.

With reference to FIG. 2, the shower rod assembly 10 includes a shower rod 16. The shower rod 16 may include two tubes, an outer tube 18 that receives an inner tube 20. The tubes 18, 20 slide telescopically relative to one another to adjust the length of the shower rod 16. For example, the inner tube 20 may be extended out of the outer tube 18 a certain amount to set the desired length of the rod 16. The more the tubes 18, 20 are extended relative to one another the larger the radius of curvature of the rod 16 becomes. A sleeve 22 slides along the inner tube 20, and when the tubes 18, 20 are set to the desired length for the shower rod 16, the sleeve 22 is slide so that a portion of it is inserted into the outer tube 18. The sleeve 22 helps remove any undesirable play between the tubes 18, 20. One end of each tube 18,20 includes a notch 102 that is used in connecting it to the surface mounts 12, 14, as described further below.

Figure 3:
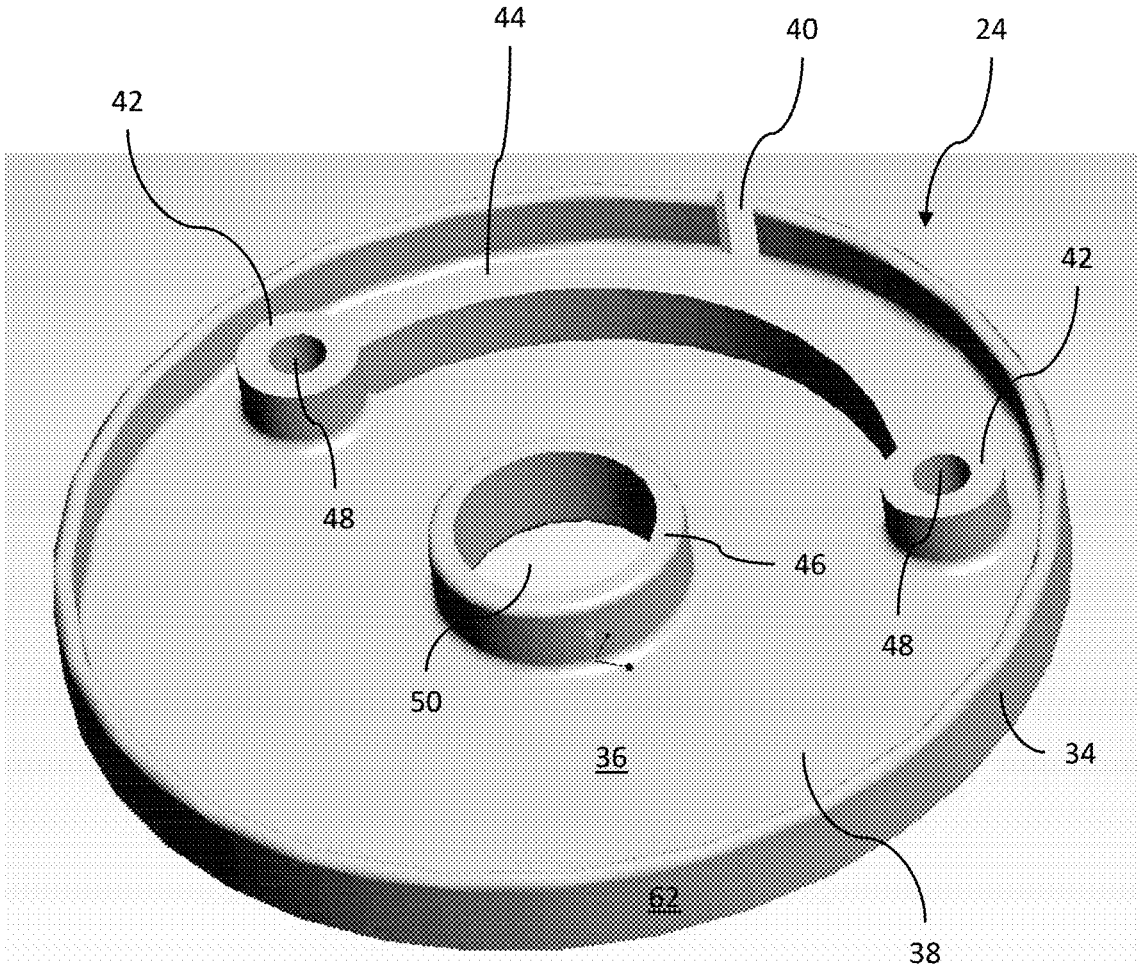
FIG. 3 is a top perspective view of a mount plate of the shower rod assembly of FIG. 1.
Figure 4A:
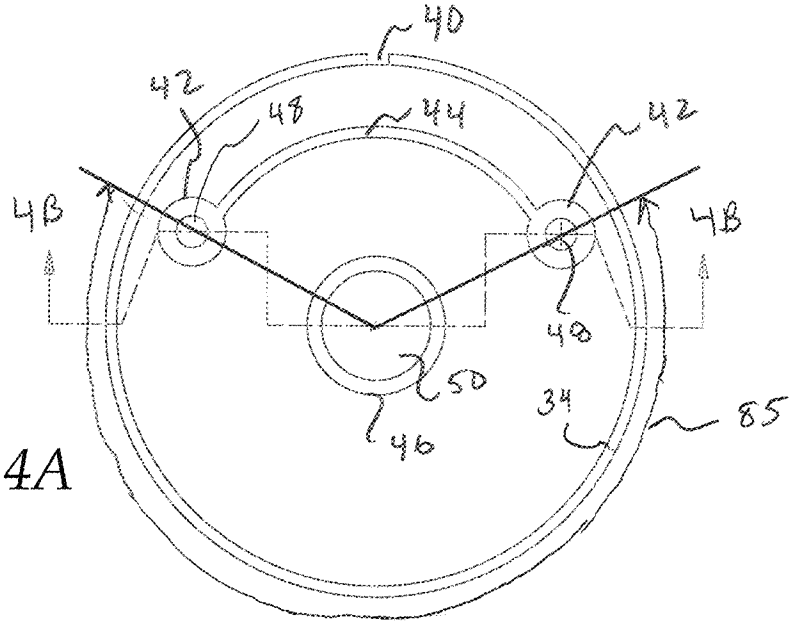
FIG. 4A is a top plan view of the mount plate of FIG. 3.
Figure 4B:
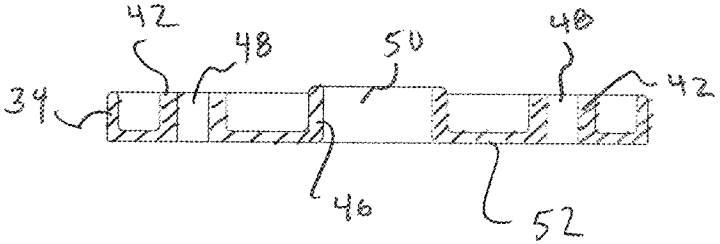
FIG. 4B is a cross-section view of the mount plate of FIG. 3 taken along line 4B-4B of FIG. 4A.

The left and right surface mounts 12, 14 each include a mount plate 24, a cover 26, a rotator plate 28, an insert, such as a tube plug, plug or insert plug 30, and a pivot pin 32. As illustrated in FIGS. 3, 4A and 4B, the mount plate 24 includes a perimeter wall 34 extending from a base 36 that defines a recess 38. The perimeter wall 34 defines a notch 40. Two small stops, such as bosses 42, extend from the base 36 into the recess 38, and an arcuate support wall 44 extends between the small bosses 42. A larger boss 46 extends from the center of the base 36. The smaller bosses 42 each define a passage 48 through the mount plate 24 for mounting screws. The larger boss 46 also defines a passage 50 through the mount plate 24. The height of the perimeter wall 34, bosses 42, 46 and arcuate support wall 44 are the same but could be different, such as less than the perimeter wall 34. A mount surface 52 of the base 26 opposite the perimeter wall 34 and bosses 42, 46 is flat in order to form a flush engagement with a mounting surface. The mount plate 24 is circular but could be any other shape.

Figure 5:
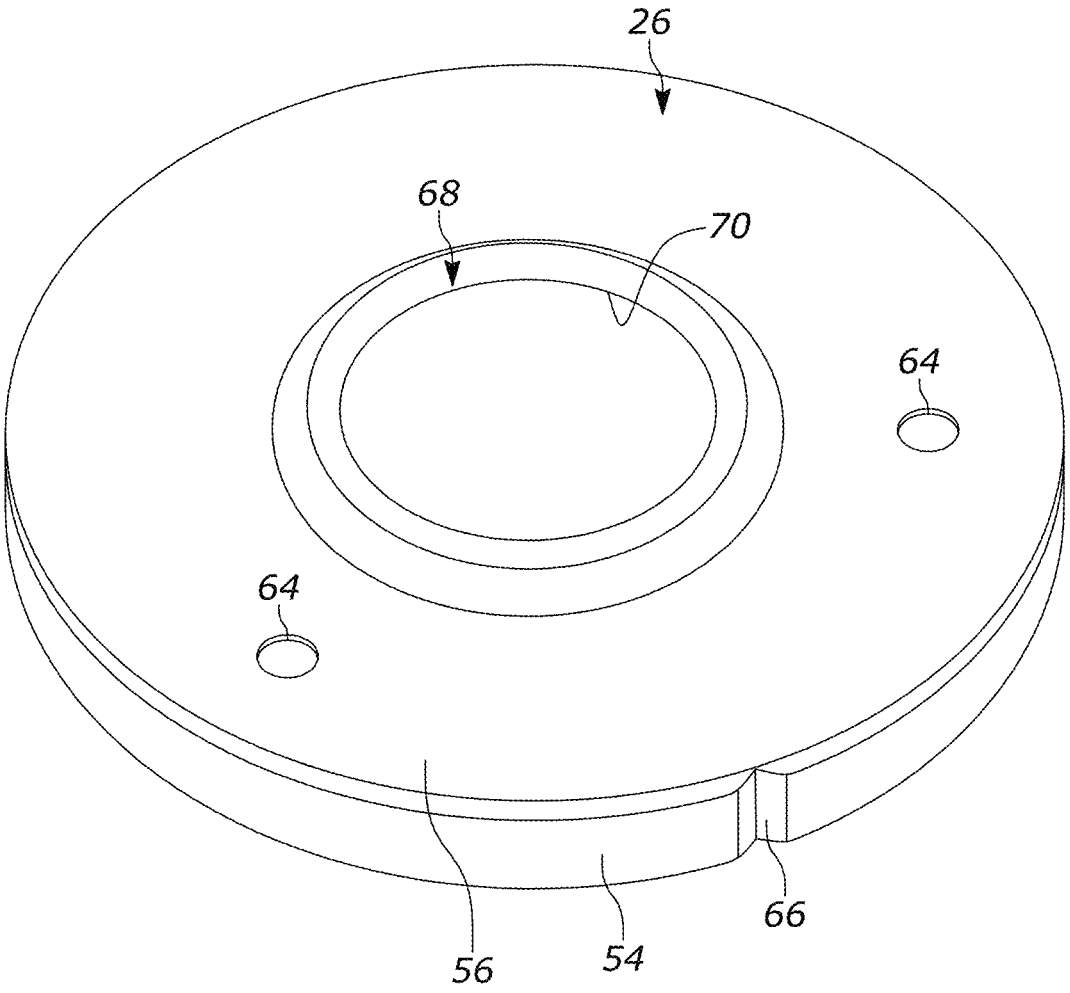
FIG. 5 is a top perspective view of a cover of the shower rod assembly of FIG. 1.
Figure 6:
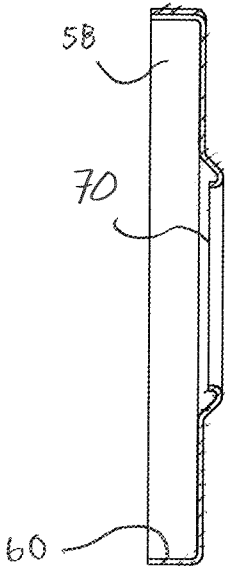
FIG. 6 is a cross-section view of the cover of FIG. 5.

As shown in FIGS. 5 and 6, the cover 26 includes a perimeter wall 54 extending from a base 56 to define a recess 58. The perimeter wall 54 includes an inner surface 60 that engages an outer surface 62 of the perimeter wall 34 of the mount plate 24. Two small holes 64 extend through the base 56 and are located to align with the small bosses 42 of the mount plate 24. The perimeter wall 54 includes a small inward projection 66 that is configured to fit into the notch 40 of the mount plate 24 to align the holes 64 with the passages 48 of the bosses 42. Mounting screws extend through the holes 64 and the passages 48 of the bosses 42 to mount the surface mounts 12, 14 to a surface. The base 56 defines a center hole 68 with a rolled inward edge 70. The rotator plate 28 extends through the center hole 66, as described below.

Figure 7:
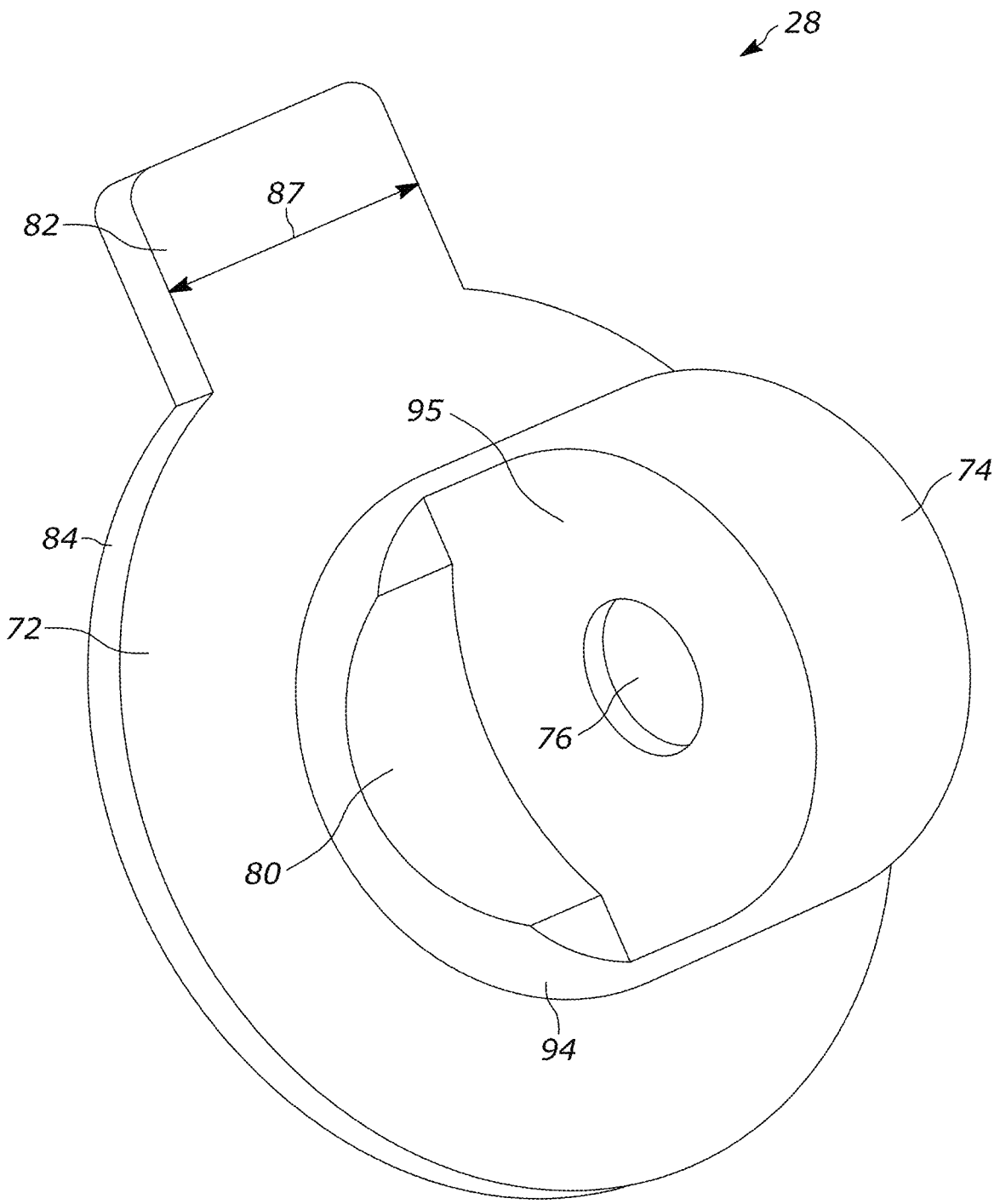
FIG. 7 is a top perspective view of a rotator plate of the shower rod assembly of FIG. 1.
Figure 8A:
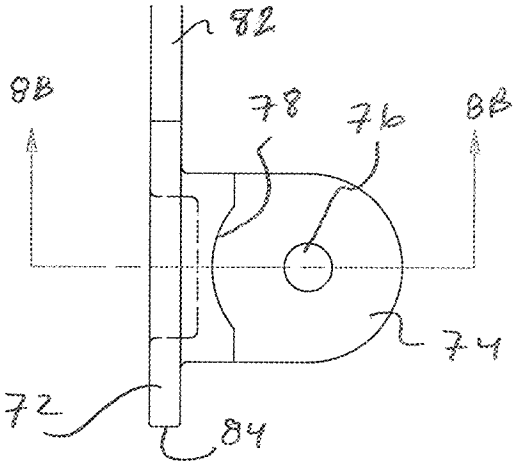
FIG. 8A is a side elevation view of the rotator plate of FIG. 7.
Figure 8B:
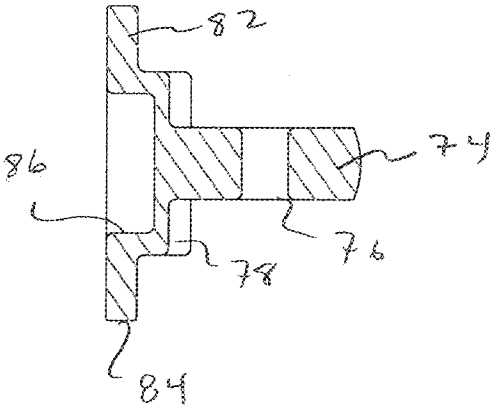
FIG. 8B is a cross-section view of the rotator plate of FIG. 7 taken along line 8B-8B of FIG. 8A.

With reference to FIGS. 7, 8A and 8B, the rotator plate 28 is located between the mount plate 24 and the cover 26 when the surface mounts 12, 14 are in the assembled condition. The rotator plate 28 includes a base portion 72 and an attachment portion 74. The attachment portion 74 extends perpendicularly from the base portion 72. The attachment portion 74 includes a circular bearing potion 94 that extends through the center hole 68 of the cover 26 when in the assembled condition. A passage 76 extends through a flat-faced, narrower portion of the attachment portion 74 for use in attaching to the tube plug 30 with the pivot pin 32. The attachment portion 74 includes an arcuate base wall 80 to provide clearance for the tube plug 30 to rotate about the pin 32. The base portion 72 is preferably circular but can be other shapes.

An arm 82 extends radially from a perimeter wall 84 of the base portion 72 to limit rotation of the rotator plate 28 in the recess 38 of the mount plate 24. The size of the base portion 72 is such that it resides in the recess 38 of the rotator plate 24 inside the bosses 42 so that the arm 82 abuts the bosses 42 to prevent further rotation of the rotator plate 28. The bosses 42 are spaced to set the two positions of the shower rod 16, the outward position and inward position relative to the bathtub. For example, the outward position could be an outward horizontal position for maximizing the size of the shower or tub enclosure for showering, and the inward position could be an inward horizontal position for maximizing space in the room around the shower or tub enclosure. The bosses 42 would be set to accommodate the necessary arcuate swing 85 for the shower rod 16 to move between these two horizontal positions. To do so, the angle 85 between the center of the bosses 42 would have to be 180 degrees plus an additional amount to account for twice the arcuate width 87 of the arm 82 where the arm 82 contacts the bosses 42 and twice the radius of the bosses 42. For instance, the angle 85 between the center of the bosses 42 could be about 233 degrees where the bosses 42 each have a radius of curvature of inches. Further, the width 87 of arm 82 can be larger or smaller depending on the strength needed to hold the torque developed from the rod 16. This also will depend on the materials used. One material may be stainless steel. On a side opposite the attachment portion 74, the base portion 72 defines a circular 86 recess that receives and engages the larger boss 46 of the mount plate 24. The larger boss 46 guides rotation of the rotator plate 28.

Figure 9:
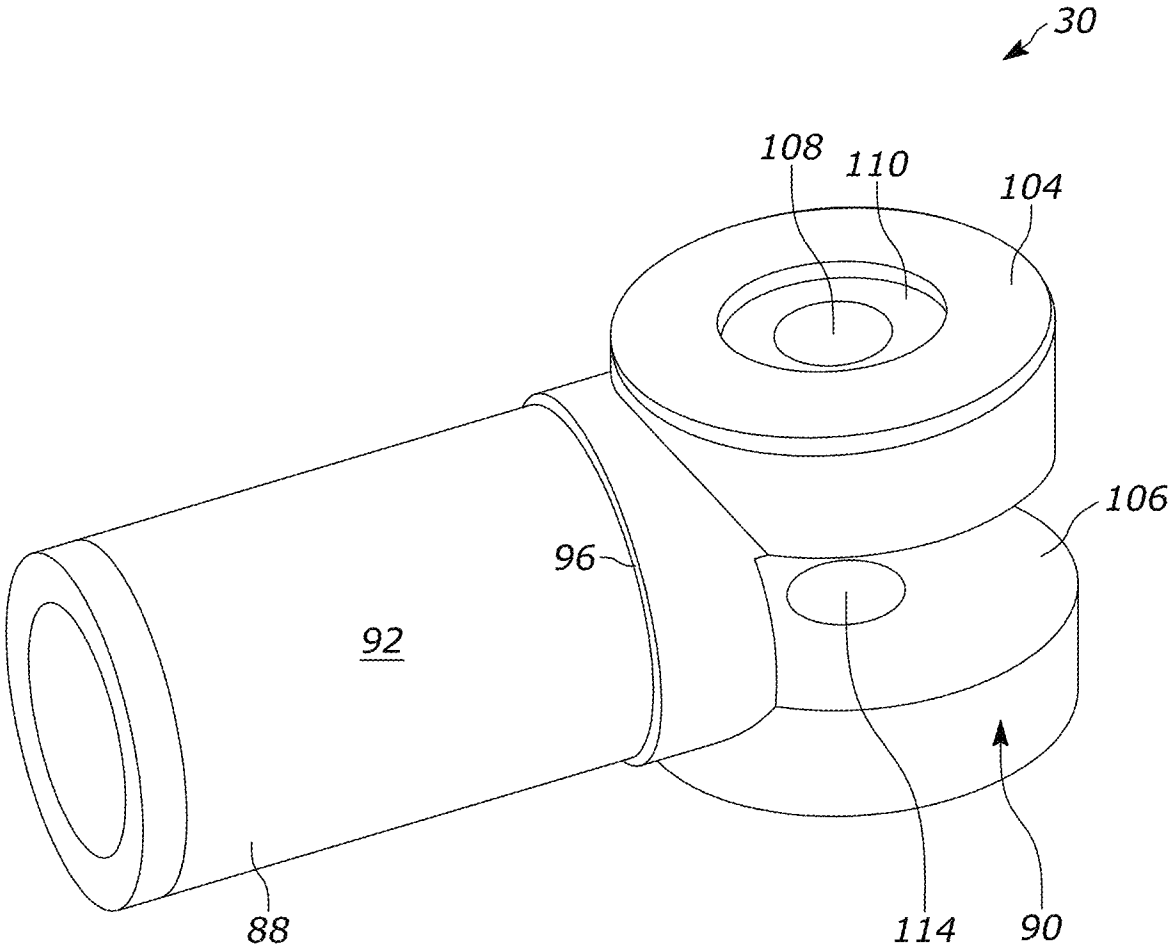
FIG. 9 is a top perspective view of a tube plug of the shower rod assembly of FIG. 1.
Figure 10A:
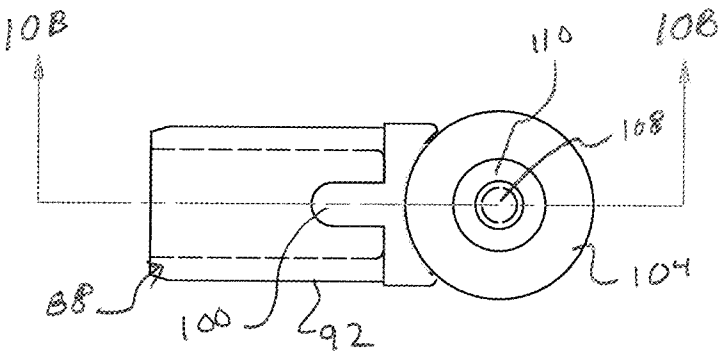
FIG. 10A is a side elevation view of the tube plug of FIG. 9.
Figure 10B:
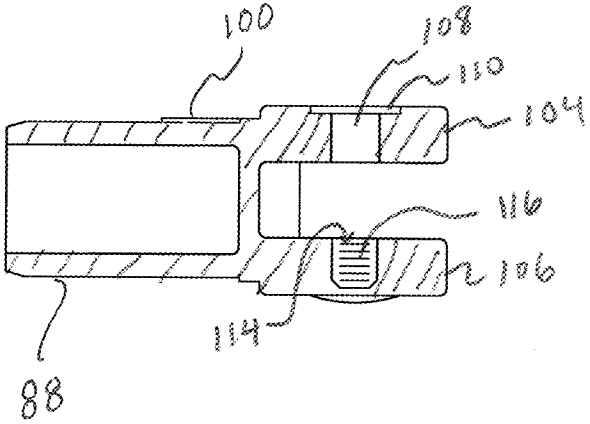
FIG. 10B is a cross-section view of the tube plug of FIG. 9 taken along line 10B-10B of FIG. 10A.

Turning to FIGS. 9, 10A and 10B, the tube plug 30 includes a cylindrical portion 88 and a yoke portion 90. The cylindrical portion 88 has an outer surface 92 that engages an inner surface of the tubes 18, 20 with a friction fit such that it remains in the tubes 18, 20. The outer diameter of one of the plugs 30 is larger than the other. The larger version is used with the outer tube 18 while the other version is used with the inner tube 20. An annular stepped edge 96 on the cylindrical portion 88 engages an end edge 98 of the tubes 18, 20 (FIG. 2) to prevent further insertion into the tubes 18, 20. The outer surface 92 also includes a short longitudinal projection 100 that aligns with and extends into a complementary notch 102 (FIG. 2) formed in the end of the tubes 18, 20. This secures the insert plugs 30 to their respective tube 18, 20 so that they rotate together. The projection 100 and notch 102 also orient the inner and outer tubes 18, 20 so that the yoke portion 90 connects to the attachment portion with the shower rod 16 in the correct orientation relative to the bosses 42. The projection 100 and the notch 102 are pre-coordinated with the arcuate spacing 85 of the bosses 42 so that the shower rod 16 is limited to a pre-determined arcuate swing, such as to inward and outward horizontal positions. The cylindrical portion 88 can be hollow to reduce material during manufacturing.

The yoke portion 90 includes a first arm 104 and a second arm 106. The arms 104, 106 are spaced to receive with slight clearance flat-faced, narrow portion 95 of the attachment portion 72 of the rotator plate 28. The clearance can be such that the parts move relative to one another but eliminate lateral wobble between them. A hole 108 extends through the first arm 104, and the hole 108 is surrounded by a recess 110 for countersinking a head 112 of the pin 32. A closed end bore 114 extends into the second arm 106. The bore 114 includes threading 116 to mesh with threading 118 on the pin 32. The hole 108 and the bore 114 align with the passage 76 of the attachment portion 74.

Figure 11:
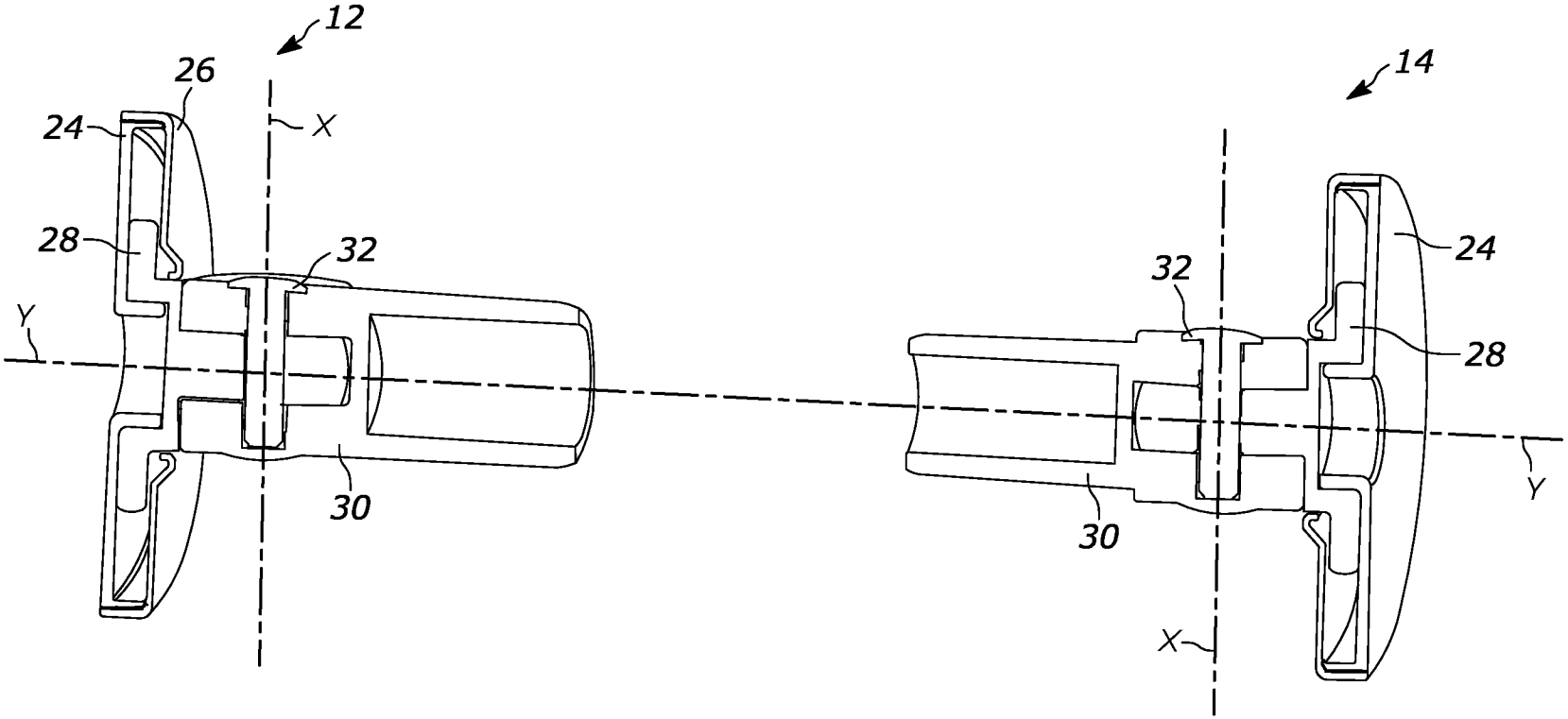
FIG. 11 is a cross-section view of left and right surface mounts of the shower rod assembly of FIG. 1.

FIG. 11 illustrates the left and right surface mounts 12, 14 in their assembled condition. The assembled surface mounts 12, 14 provide a first axis of rotation Y via the rotator plate 28 and a second axis X of rotation by way of the pin 32. The two axes X,Y of rotation allow the shower rod 16 to move between its two positions.

Figure 12:
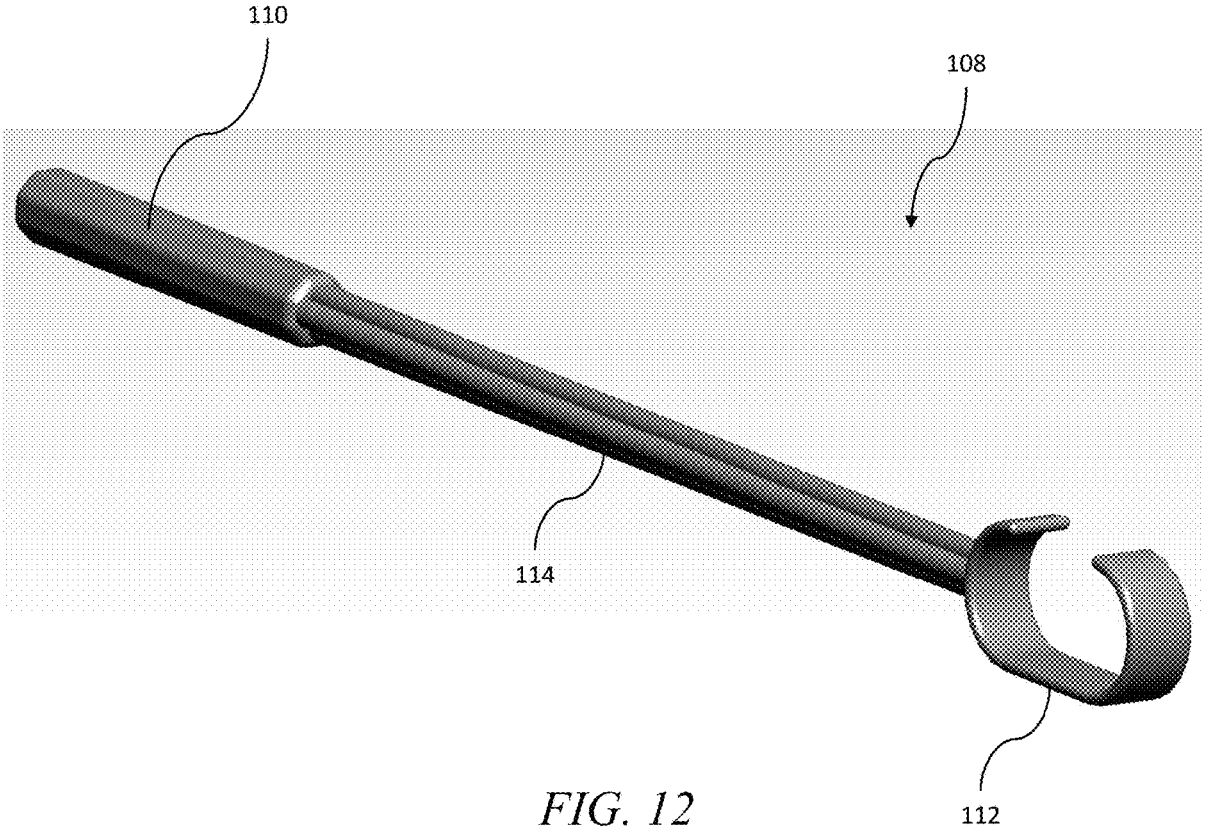
FIG. 12 is a side perspective view of a tool to be used to assist in rotating the shower rod assembly of FIG. 1.
Figure 13:
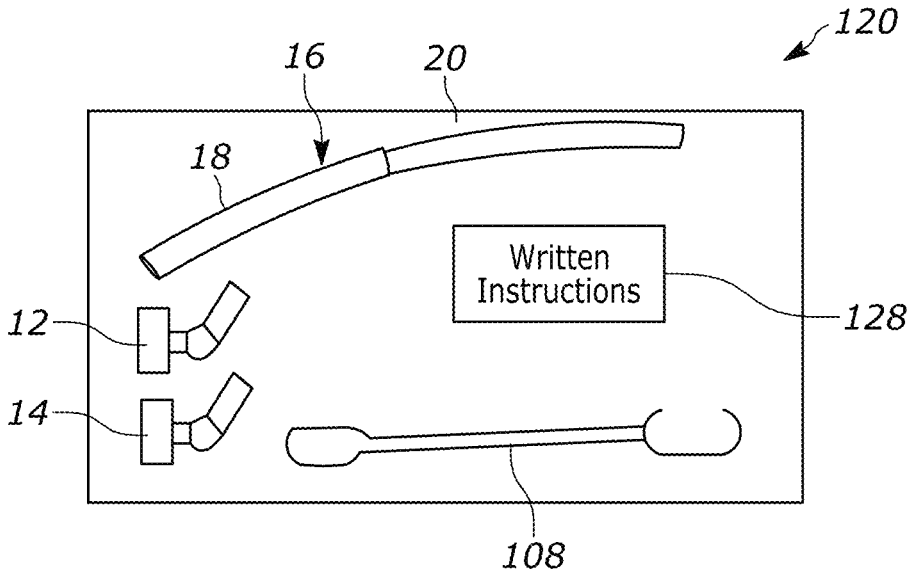
FIG. 13 is a plan view of a container containing the shower rod assembly of FIG. 1, the tool of FIG. 12, and written instructions.
Figure 14:
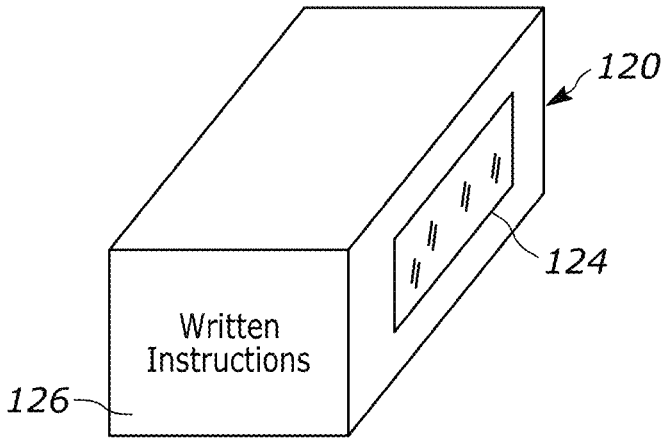
FIG. 14 is a perspective view of the container of FIG. 13 with written instructions on the container and a transparent window.

With reference to FIG. 12, there is illustrated a tool 108 to reach and assist in rotating the shower rod 16 between its two positions. The tool 108 includes a handle 110 at one end, an elongated C-shaped hook 112 at the other end, and an extension portion 114 extending between the handle 110 and the hook 112. The hook 112 can have any configuration, such as circular, triangular, rectangular, provided with a split to allow the shower rod 16 to enter into the grasp of the hook 112. The hook 112 can be used to receive the shower rod 16 through the split. Once attached to the shower rod 16, the tool 108 can be used to manually lift and rotate the shower rod 16 between the two positions. The tool 108 can be molded as a single piece component, or it can be made of multiple components.

The shower rod assembly 10 can be packaged together as a kit in a single container or packaging 120. The kit in the container 120 may also include the tool 108. The container 120 may be made of transparent material or may contain windows 124 to display some or all of the contents. The container 120 may include indicia or an indicia placard to describe some or all of the contents and/or provide instructions 126 on how to install the shower rod assembly. The instructions 128 also may be provided separate from the container and published in written form contained in the container and/or online at a website.

To install the shower rod assembly, positions on the mounting surface are first determined for the height and lateral location relative to the shower and/or bathtub enclosure for the left and right surface mounts 12, 14. The locations for the mounting screws are then located using a template provided with the kit as part of the container or the passages 48 through the bosses 42 the mount plate 24 and/or the aligned holes 64 of the cover 26 with the passages 42 of the bosses 42 of mount plate 24 of assembled left and right surface mounts 12, 14. It is desired to orient left and right surface mounts 12, 14 so that the notch 40 of the mount plate 24 and the inward projection 66 of the cover 26 are at the top (or 12:00) position. This ensures that the mounting screws are in an upper portion of the mount plate 24, which provides a more secure installation as opposed to the screws being in a lower portion. This ensures that bosses 42 provide the shower rod 16 with the intended positions, such as two horizontal positions, with the arm 82 operating in the lower portion of the mount plate 24.

The locations for the mounting screws on the mounting surface may be pre-drilled and/or prepared with other components, such as expandable inserts placed in the pre-drilled holes. The left and right surface mounts 12, 14 can be pre-assembled, such as at the supplier and/or factory, or they can be assembled as part of the installation process. Alternatively, the rotator plate 28 may be placed in the recess 38 of the mount plate 28, and the cover 26 may be placed over the mounting plate 24 and the rotator plate 28. Other fasteners, such as nails, ribbed nails and mollies, may be used. Next, the mounting screws are threaded into the pre-drilled holes or are driven directly into the surface without pre-drilling. They are tightened to secure the surface mounts 12, 14 to the mounting surface. The height of bosses 42 and the arcuate support wall 44 can be selected to prevent overtightening that would squeeze and impede rotation of the rotator plate 28.

After installation of the surface mounts 12, 14, the shower rod 16 is installed. The tube plugs 30 can already be pre-installed into the ends of the outer and inner tubes 18, 20 at the supplier and/or factory, or they can be inserted during the installation process. The outer and inner tubes 18, 20 are extended relative to one another until the narrow portions 95 of the tube plugs 30 are positioned in the yoke portion 90 of their respective attachment portion 76. The pins 32 are then installed to secure the narrow portions 95 in their respective yoke portion 90.

It will be understood that various changes in the details, materials, and arrange-ments of parts and components which have been herein described and illustrated in order to explain the nature of the systems and operations may be made by those skilled in the art within the principle and scope of the subject matter expressed in the appended claims. Furthermore, while various features have been described in connection with particular embodiments, it will be appreciated that features described for one embodiment also may be incorporated with the other described embodiments.

What is claimed is:

1. A rotatable shower rod system comprising:

a first mounting assembly;

a second mounting assembly;

a curved shower rod extending between the first and second mounting assemblies;

each of the first and second mounting assemblies including a stationary plate and a rotational plate, the stationary plate including a first stop spaced from a second stop and the rotational plate including a base with a perimeter and at least one arm extending radially outwardly from the perimeter of the base to engage the first stop and the second stop to prevent rotation of the rotational plate; and the stationary plate and the rotational plate overlapping each other at least in part, the stationary plate including a first annular wall projecting from the stationary plate, and the base of the rotational plate including a recess defined in part by a second annular wall projecting from the base, the base defining an annular flange extending from and about the second annular wall at an open end of the recess to engage the stationary plate, the recess receiving the first annular wall of the stationary plate and having a floor overlaying the first annular wall of the stationary plate, the first annular wall of the stationary plate and the second annular wall of the rotational plate being spaced radially inward of the perimeter of the base and engaging one another to guide rotation of the rotational plate relative to the stationary plate.

2. The rotatable shower rod system of claim 1 wherein the curved shower rod comprises an outer tube and an inner tube and the outer and inner tubes are capable of moving relative to one another.

3. The rotatable shower rod system of claim 1 wherein the first stop and the second stop define mounting passages for fasteners to fasten the stationary plate to a surface.

4. The rotatable shower rod system of claim 1 further comprising a support intermediate the first stop and the second stop.

5. The rotatable shower rod system of claim 1 further comprising a cover defining a hole and directly overlaying an entirety of the perimeter of the base of the rotational plate.

6. The rotatable shower rod system of claim 1 further comprising a pair of inserts attached to the curved shower rod.

7. The rotatable shower rod system of claim 6 wherein the pair of inserts include a threaded hole.

8. A rotatable shower rod system of claim 6 wherein the inserts include a portion coordinated with a position of the first stop and the second stop.

9. The rotatable shower rod system of claim 1 further comprising a tool to rotate the curved shower rod.

10. A rotatable shower rod assembly comprising:

a curved shower rod having a first curved rod and a second curved rod that telescopically move relative to one another between at least a first combined operational length and a second combined operational length;

a pair of mounting brackets that provide two axes of rotation for the curved shower rod;

each of the mounting brackets comprising a stationary plate, a rotational plate, and a removable cover, the stationary plate including a first stop spaced from a second stop to engage the rotational plate to limit rotation of the rotational plate relative to the stationary plate, and the removable cover having an annular portion that directly overlays an entire perimeter of the rotational plate in an axial direction such that there is no structure between the annular portion and the entire perimeter of the rotational plate in in the axial direction;

an elongated tool to rotate the curved shower rod when installed; and packaging enclosing at least a portion of the curved shower rod, the pair of mounting brackets and the elongated tool.

11. The rotatable shower rod assembly of claim 10 further comprising written installation instructions printed on the packaging.

12. The rotatable shower rod assembly of claim 10 further comprising written instructions contained in the packaging.

13. The rotatable shower rod assembly of claim 10 wherein the packaging includes windows.

14. The A rotatable shower rod assembly of claim 10 wherein the packaging is at least partially transparent.

15. A rotatable shower rod system comprising:

a first mounting assembly;

a second mounting assembly;

a curved shower rod extending between the first and second mounting assemblies and having a curved outer tube and a curved inner tube capable of telescopically moving relative to one another between at least a first combined operational length and a second combined operational length; and each of the first and second mounting assemblies including a stationary component and a rotational component, the stationary component including a first projection defining a first mounting passage spaced from a second projection defining a second mounting passage, the first mounting passage and the second mounting passage sized to receive a fastener for fastening the stationary component to a surface, wherein a radial projection extends from the rotational component a sufficient distance to be selectively engaged with the first projection and the second projection at the first mounting passage and the second mounting passage, respectively.

16. The rotatable shower rod system of claim 15 wherein the first curved outer tube and the second curved inner tube telescope relative to one another.

17. The rotatable shower assembly of claim 10, wherein mounting passages for fasteners to mount the stationary plate to a surface define the first stop and the second stop and a tab extending from the rotational plate and the mounting passages are radially aligned about a center of the stationary plate such that the tab abuts the mounting passages during rotation of the rotational plate, and the removable cover includes two holes that align with the mounting passages for mounting the removable cover to the stationary plate and to the surface.

18. The rotatable shower rod system of claim 15, comprising a removable cover configured to cover the rotational component and the stationary component, and the removable cover includes two holes that align with the first mounting passage and the second mounting passage for mounting the removable cover to the stationary plate and to the surface.

* * * * *